US006810592B1

(12) United States Patent
Oldfield, Jr.

(10) Patent No.: US 6,810,592 B1
(45) Date of Patent: Nov. 2, 2004

(54) ADJUSTABLE DOOR JAMB SETTING JIG

(76) Inventor: Patrick J. Oldfield, Jr., 5618 SE. Avalon Dr., Stuart, FL (US) 34997

( * ) Notice: Subject to any disclaimer, the term of this patent is extended or adjusted under 35 U.S.C. 154(b) by 0 days.

(21) Appl. No.: 10/352,410

(22) Filed: Jan. 29, 2003

(51) Int. Cl.[7] ..... E04F 21/00

(52) U.S. Cl. ..... 33/194; 33/464; 33/374; 33/347; 33/370; 33/474; 33/DIG. 1

(58) Field of Search ..... 33/194, 645, 464, 33/347, 374–375, 370–371, DIG. 1, 474, 478

(56) References Cited

U.S. PATENT DOCUMENTS

| | | | | | |
|---|---|---|---|---|---|
| 2,813,348 | A | | 7/1957 | Kristensen | |
| 2,867,911 | A | * | 1/1959 | Atkinson | 33/194 |
| 2,949,948 | A | * | 8/1960 | Zern | 33/194 |
| 3,015,348 | A | | 1/1962 | Zern | |
| 3,059,341 | A | | 6/1962 | Becker | |
| 3,065,550 | A | | 11/1962 | Pattiani | |
| 3,408,744 | A | * | 11/1968 | Fitzgerald | 33/194 |
| 3,753,556 | A | | 8/1973 | Nix | |
| D271,087 | S | | 10/1983 | Gianos | |
| 4,635,414 | A | * | 1/1987 | Allen | 33/194 |
| 4,794,700 | A | * | 1/1989 | Kessel | 33/194 |
| 4,910,876 | A | * | 3/1990 | Channell | 33/194 |
| 5,167,073 | A | | 12/1992 | Stein | |
| 5,396,707 | A | * | 3/1995 | Blase | 33/194 |
| 5,560,112 | A | * | 10/1996 | Stein et al. | 33/194 |
| 5,775,036 | A | * | 7/1998 | Stanley, Sr. | 33/194 |
| 6,282,852 | B1 | * | 9/2001 | Walcker | 33/194 |
| 6,442,853 | B1 | * | 9/2002 | Hale et al. | 33/194 |
| 6,615,500 | B2 | * | 9/2003 | Hale et al. | 33/194 |
| 2002/0170189 | A1 | * | 11/2002 | Cheatham | 33/194 |

* cited by examiner

*Primary Examiner*—Diego Gutierrez
*Assistant Examiner*—Yaritza Guadalupe

(57) ABSTRACT

An adjustable door jamb setting jig for installing metal door frames in building structures. The adjustable door jamb setting jig includes a base frame being made of wood material; and also includes an extension frame being made of metal material and being extendable from and fastenable to the base frame; and further includes fastening members for fastening the extension frame to the base frame; and further includes magnets being attached to the base frame for holding the base frame to a metal door jamb.

3 Claims, 2 Drawing Sheets

ADJUSTABLE DOOR JAMB SETTING JIG

BACKGROUND OF THE INVENTION

1. Field of the Invention

The present invention relates to door jamb setting jigs and more particularly pertains to a new adjustable door jamb setting jig for installing metal door frames in building structures.

2. Description of the Prior Art

The use of door jamb setting jigs is known in the prior art. More specifically, door jamb setting jigs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,059,341; 3,753,556; 2,813,348; 5,167,073; 3,065,550; 3,015,348; and Des. 271,087.

While these devices fulfill their respective, particular objectives and requirements, the aforementioned patents do not disclose a new adjustable door jamb setting jig. The prior art includes frames being adjustable to one another to establish the size of the door frames for building structures.

SUMMARY OF THE INVENTION

The general purpose of the present invention, which will be described subsequently in greater detail, is to provide a new adjustable door jamb setting jig which has many of the advantages of the door jamb setting jigs mentioned heretofore and many novel features that result in a new adjustable door jamb setting jig which is not anticipated, rendered obvious, suggested, or even implied by any of the prior art door jamb setting jigs, either alone or in any combination thereof. The present invention includes a base frame being made of wood material; and also includes an extension frame being made of metal material and being extendable from and fastenable to the base frame; and further includes fastening members for fastening the extension frame to the base frame; and further includes magnets being attached to the base frame for holding the base frame to a metal door jamb. None of the prior art includes the combination of the elements of the present invention.

There has thus been outlined, rather broadly, the more important features of the adjustable door jamb setting jig in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new adjustable door jamb setting jig which has many of the advantages of the door jamb setting jigs mentioned heretofore and many novel features that result in a new adjustable door jamb setting jig which is not anticipated, rendered obvious, suggested, or even implied by any of the prior art door jamb setting jigs, either alone or in any combination thereof.

Still another object of the present invention is to provide a new adjustable door jamb setting jig for installing metal door frames in building structures.

Still yet another object of the present invention is to provide a new adjustable door jamb setting jig that is easy and convenient to set up and use.

Even still another object of the present invention is to provide a new adjustable door jamb setting jig that saves the user substantial time in setting up and measuring door frames for particular building structures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
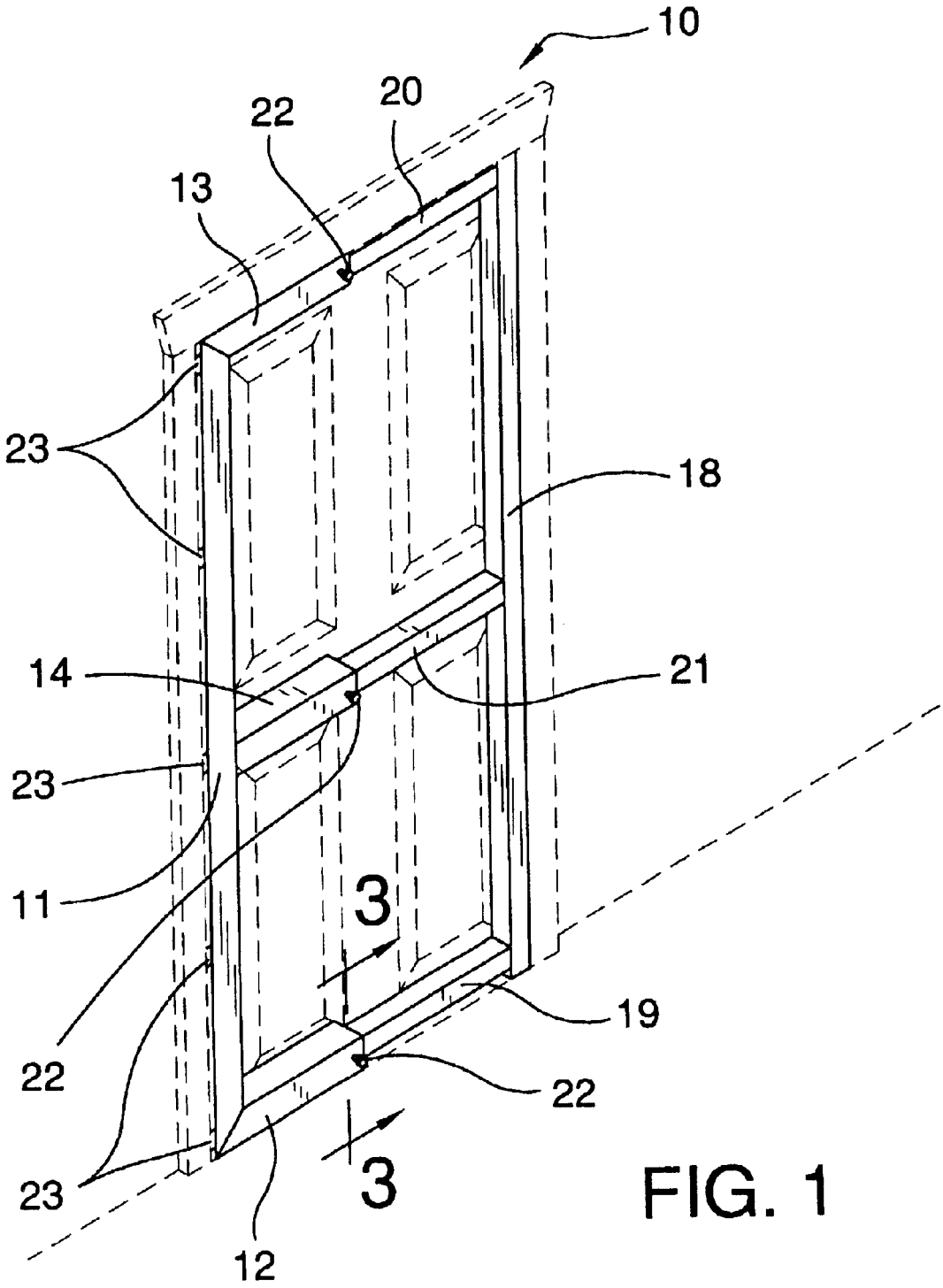
FIG. 1 is a perspective view of a new adjustable doorjamb setting jig according to the present invention.
Figure 2:
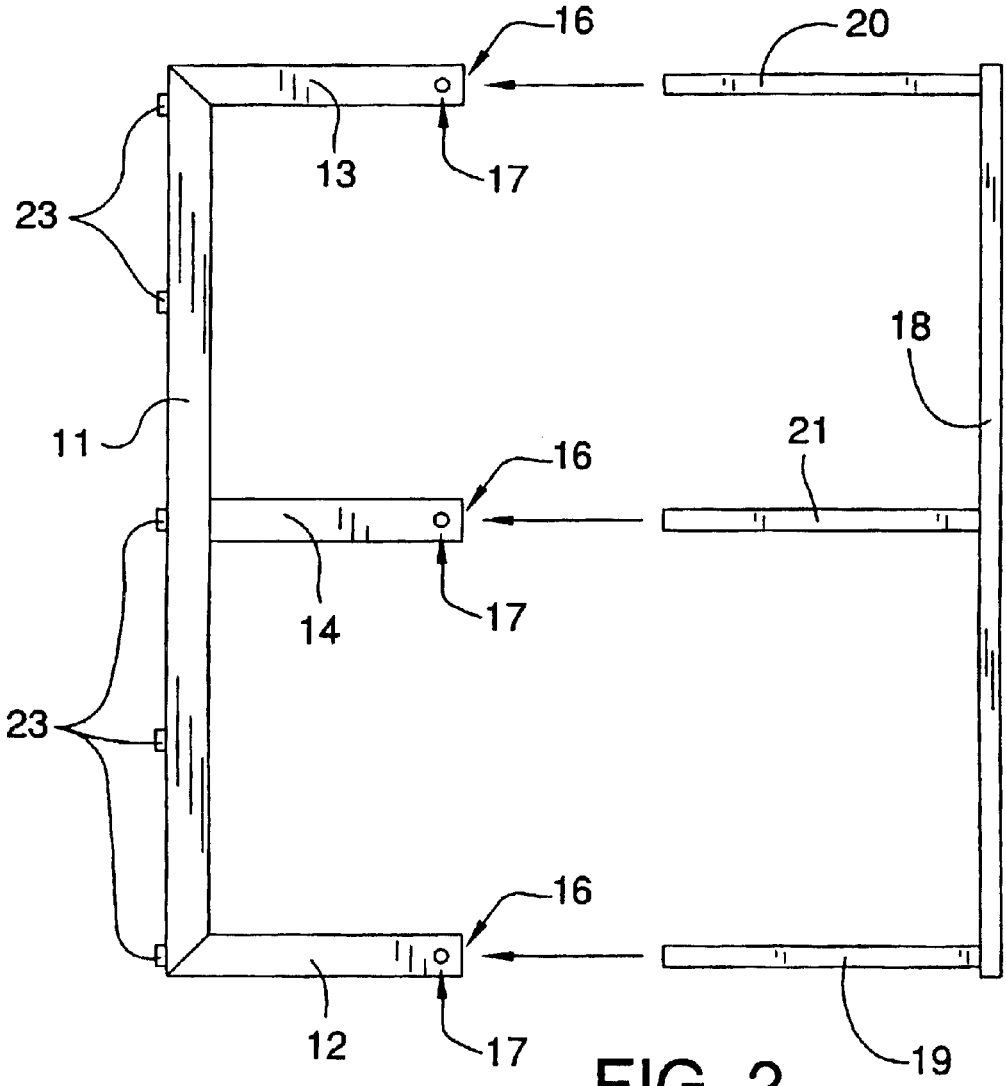
FIG. 2 is an exploded front elevational view of the present invention.
Figure 3:
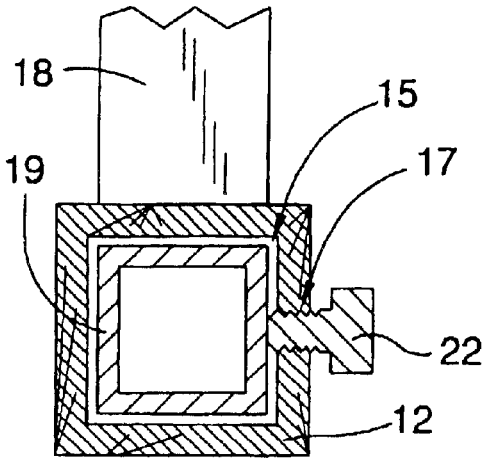
FIG. 3 is a detailed cross-sectional view of the present invention.

With reference now to the drawings, and in particular to FIGS. 1 through 3 thereof, a new adjustable door jamb setting jig embodying the principles and concepts of the present invention and generally designated by the reference numeral 10 will be described.

As best illustrated in FIGS. 1 through 3, the adjustable door jamb setting jig 10 generally comprises a base frame 11 being made of wood material. The base frame includes an elongate base member 11 and a plurality of tubular branch members 12–14 being conventionally attached to and extending generally perpendicular to the elongate base member 11. Each of the tubular branch members 12–14 has an open end 16 and a bore 15 extending therein and also a hole 17 being disposed through a wall thereof into the bore 15. The tubular branch members 12–14 includes a bottom tubular branch member 12 being conventionally attached to and extending outwardly at a bottom end of the elongate base member 11, and also includes a top tubular branch member 13 being conventionally attached to and extending outwardly at a top end of the elongate base member 11, and further includes an intermediate tubular branch member 14 being conventionally attached to and extending outwardly at a central position of the elongate base member 11 with the tubular branch members 12–14 being disposed generally perpendicular to one another. Each of the tubular branch members 12–14 is multi-sided and has generally a square lateral cross-section.

An extension frame is made of metal material and is extendable from and fastenable to the base frame. The extension frame includes an elongate support member 18 and also includes a plurality of elongate extension members 19–21 being conventionally attached to and extending generally perpendicular from the elongate support member 18. Each of the elongate extension members 19–21 is fastenably received in and extended from the bore 15 of a respective one of the elongate branch members 12–14. The elongate extension members 19–21 includes a bottom elongate extension 19 member being conventionally attached to and extending outwardly at a bottom end of the elongate support member 18, and also includes a top elongate extension member 20 being conventionally attached to and extending outwardly at a top end of the elongate support member 18, and further includes an intermediate elongate extension member 21 being conventionally attached to and extending outwardly at a central position of the elongate support member 18 with the elongate extension members 19–21 being disposed generally perpendicular to one another Fastening members 22 for fastening the extension frame to the base frame are set screws which are threadable through the holes 17 of the elongate branch members 12–14 and are engagable to the elongate extension members 19–21 to fasten the elongate extension members 19–21 at selective extended positions relative to the elongate branch members 12–14. Magnets 23 are conventionally attached to the base frame for holding the base frame to a metal door jamb. The magnets 23 are conventionally attached to an outer side of and spacedly disposed along a length of the elongate base member 11.

In use, the user attaches the base frame to the metal frame, and extends and sets the extension frame from the base frame using the set screws 22 which identifies the size of the door frame so that the user can finish constructing the door frame without having to user measuring tools in particular.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings-and described in the specification are intended to be encompassed by the present invention.

Therefore, the foregoing is considered as illustrative only of the principles of the adjustable door jamb setting jig. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable door jamb setting jig comprising:

a base frame being made of wood material, said base frame including an elongate base member and a plurality of tubular branch members extending generally perpendicular to said elongate base member, each of said tubular branch member having an open end and a bore extending therein and also a hole being disposed through a wall thereof into said bore, said tubular branch members including a bottom tubular branch member extending outwardly at a bottom end of said elongate base member, and also including a top tubular branch member extending outwardly at a top end of said elongate base member, and further including an intermediate tubular branch member extending outwardly at a central position of said elongate base member, said tubular branch members being disposed generally perpendicular to one another, each of said tubular branch members being multi-sided and having generally a square lateral cross-section;

an extension frame being made of metal material and being extendable from and fastenable to said base frame, said extension frame including an elongate support member and also including a plurality of elongate extension members being attached to and extending generally perpendicular from said elongate support member, each of said elongate extension members being fastenably received in and extended from said bore of a respective one of said elongate branch members, said elongate extension members including a bottom elongate extension member extending outwardly at a bottom end of said elongate support member, and also including a top elongate extension member extending outwardly at a top end of said elongate support member, and further including an intermediate elongate extension member extending outwardly at a central position of said elongate support member, said elongate extension members being disposed generally parallel to one another;

fastening members for fastening said extension frame to said base frame: and magnets being attached to said base frame for holding said base frame to a metal door jamb.

2. An adjustable door jamb setting jig as described in claim 1 wherein said fastening members are set screws which are threadable through said holes of said elongate branch members and are engagable to said elongate extension members to fasten said elongate extension members at selective extended positions relative to said elongate branch members.

3. An adjustable door jamb setting jig as described in claim 2 wherein said magnets are attached to an outer side of and spacedly disposed along a length of said elongate base member.

* * * * *